US011492833B2

(12) United States Patent
Sperger et al.

(10) Patent No.: US 11,492,833 B2
(45) Date of Patent: Nov. 8, 2022

(54) GUIDE SYSTEM FOR GUIDING A DOOR LEAF

(71) Applicant: Julius Blum GmbH, Hoechst (AT)

(72) Inventors: Thomas Sperger, Hard (AT); Benjamin Hoffmann, Dornbirn (AT); Ingo Gasser, Hoechst (AT)

(73) Assignee: JULIUS BLUM GMBH, Hoechst (AT)

( * ) Notice: Subject to any disclaimer, the term of this patent is extended or adjusted under 35 U.S.C. 154(b) by 599 days.

(21) Appl. No.: 16/580,580

(22) Filed: Sep. 24, 2019

(65) Prior Publication Data

US 2020/0018108 A1 Jan. 16, 2020

Related U.S. Application Data

(63) Continuation of application No. PCT/AT2018/000035, filed on May 4, 2018.

(30) Foreign Application Priority Data

May 11, 2017 (AT) ..... A 50390/2017

(51) Int. Cl.
*E05D 15/58* (2006.01)
*E05D 15/26* (2006.01)

(52) U.S. Cl.
CPC ..... *E05D 15/58* (2013.01); *E05D 15/264* (2013.01); *E05Y 2900/212* (2013.01); *Y10T 16/379* (2015.01)

(58) Field of Classification Search
CPC ... E05D 15/58; E05D 15/264; E05D 15/0652; E05D 2900/212; E05D 2201/638;
(Continued)

(56) References Cited

U.S. PATENT DOCUMENTS 5,131,449 A 7/1992 Winn et al.
7,322,661 B1 * 1/2008 Salvesen ..... E05D 15/58 312/298

(Continued)

FOREIGN PATENT DOCUMENTS

CN 103161375 6/2013
CN 103703204 4/2014

(Continued)

OTHER PUBLICATIONS

International Search Report dated Aug. 3, 2018 in International (PCT) Application No. PCT/AT2018/000035.

(Continued)

*Primary Examiner* — William L Miller
(74) *Attorney, Agent, or Firm* — Wenderoth, Lind & Ponack, L.L.P.

(57) ABSTRACT

A guide system includes a first guide rail, a guide carriage configured to be connected to the door wing and configured to run along the first guide rail, a second guide rail separate from the first guide rail, the second guide rail extending transversely to the first guide rail in a mounted condition, a carrier configured to be displaceable relative to the second guide rail, the guide carriage can be arranged on the carrier, and a transfer device for transferring the guide carriage at least from the first guide rail to the carrier. The transfer device includes a control curve configured to be bow-shaped at least over a region, so that the guide carriage, upon a transfer from the first guide rail to the carrier, can be moved at least over a region in a direction of the second guide rail.

14 Claims, 10 Drawing Sheets

(58) Field of Classification Search
CPC ..... E06B 3/5045; E06B 3/509; E05F 11/54; Y10T 16/35; Y10T 16/379; E05Y 2900/212; E05Y 2201/638
USPC ..... 160/201, 214; 16/87 R, 96 R
See application file for complete search history.

(56) References Cited

U.S. PATENT DOCUMENTS

| | | | | |
|---|---|---|---|---|
| 8,671,633 | B2 | 3/2014 | Haab et al. | |
| 9,068,386 | B2 | 6/2015 | Ishii et al. | |
| 10,400,493 | B2 * | 9/2019 | Gabi | E05D 15/264 |
| 10,676,974 | B2 * | 6/2020 | Wojdyla | A61G 3/061 |
| 10,876,340 | B2 * | 12/2020 | Rupp | E06B 3/482 |
| 11,008,791 | B2 * | 5/2021 | Rupp | E05F 1/08 |
| 11,136,804 | B2 * | 10/2021 | Rupp | E05F 5/003 |
| 11,274,482 | B2 * | 3/2022 | Rupp | E05D 15/58 |
| 2013/0145705 | A1 | 6/2013 | Haab et al. | |
| 2014/0224435 | A1 | 8/2014 | Stawski | |
| 2015/0008811 | A1 * | 1/2015 | Ishii | E06B 3/5045 312/322 |
| 2017/0260789 | A1 | 9/2017 | Gabi | |
| 2019/0301218 | A1 * | 10/2019 | Rupp | E05F 1/08 |
| 2019/0330896 | A1 * | 10/2019 | Rupp | E05D 15/264 |
| 2021/0246699 | A1 * | 8/2021 | Göetz | E05D 15/264 |
| 2021/0246700 | A1 * | 8/2021 | Hoffmann | E05D 15/264 |
| 2021/0262269 | A1 * | 8/2021 | Goetz | E05D 15/581 |

FOREIGN PATENT DOCUMENTS

| | | |
|---|---|---|
| CN | 104080992 | 10/2014 |
| DE | 24 04 874 | 8/1975 |
| DE | 297 10 854 | 10/1997 |
| EP | 0 433 726 | 6/1991 |
| EP | 2 094 925 | 5/2010 |
| JP | 2010-116776 | 5/2010 |
| JP | WO2013/114730 | 8/2013 |
| JP | 5587502 | 9/2014 |
| KR | 20090006095 | 6/2009 |
| WO | 2008/074945 | 6/2008 |
| WO | 2016/081963 | 6/2016 |

OTHER PUBLICATIONS

Search Report dated Sep. 2, 2020 in corresponding Chinese Patent Application No. 201880029734.9.

* cited by examiner

GUIDE SYSTEM FOR GUIDING A DOOR LEAF

BACKGROUND OF THE INVENTION

The present invention relates to a guide system for guiding at least one movably supported door wing, the guide system comprising:

- a first guide rail,
- at least one guide carriage configured to be connected to the at least one door wing and being configured to run along the first guide rail,
- a second guide rail separate from the first guide rail, the second guide rail extending transversely to the first guide rail in a mounted condition,
- a carrier configured to be displaceable relative to the second guide rail, the at least one guide carriage can be arranged on the carrier,
- a transfer device for transferring the at least one guide carriage at least from the first guide rail to the carrier.

The invention further concerns an arrangement comprising at least one door wing and a guide system of the type to be described. Moreover, the invention relates to an item of furniture comprising such a guide system and/or an arrangement of the aforementioned type.

EP 0 433 726 B1 discloses a guide system for cabinet doors which, in the mounted position, are hingedly connected to one another by a vertically extending pivoting axis. By the guide system, the cabinet doors can be movably supported between a first position, in which the cabinet doors are aligned coplanar to one another, and a second position, in which the cabinet doors are aligned parallel to one another. In the second position, the cabinet doors are accommodated in a lateral insertion gap. The guide system includes a first guide rail extending parallel to a front face of the cabinet, and a second guide rail arranged at a right angle to the first guide rail. Moreover, a carrier is provided (reference number 5 in FIG. 1) on which a first cabinet door is hingedly supported. The carrier is displaceable via guide rails in a direction parallel to an outer wall of the cabinet in a horizontal direction, so that the two cabinet doors can be inserted into the lateral insertion gap. A guide element (reference number 7) is arranged on the second cabinet door, the guide element being configured to run along the first guide rail. A drawback with this construction is the fact that the guide element, upon the right-angled transition between the first and second guide rail, can collide with the U-shaped limbs of the guide rails. As a result, the insertion movement of the cabinet doors into the lateral insertion gap is impeded.

DE 297 10 854 U1 discloses a guide system for a folding door having two door wings hingedly connected to one another, and the door wings are configured to run along two guide rails extending at a right angle to one another. A guide element having a gliding portion is fixed to an inner door wing, the gliding portion being configured to be displaced along a bow-shaped portion arranged between the guide rails (FIG. 4). The bow-shaped portion is thereby configured as a one-piece component together with a guide rail. A drawback is the fact that the door wings, in a parallel position to one another, can only be moved with a high manual effort in a direction of the depth of the cabinet.

DE 24 04 874 A1 discloses a room portioning wall having a plurality of wall elements configured to be moved via running carriages along a guide rail. If the wall elements are no longer be used for room portioning purposes, the wall elements can be packaged in a storeroom. For this purpose, the storeroom has a plurality of rail portions configured to be moved along transverse carriers. Each wall element is associated to such a rail portion, and the rail portions can alternatively be arranged in a position being flush with the guide rail. As a result, a transfer of the wall elements from the guide rail to the rail portions can be enabled. The wall elements, when not in use, are thus individually transferred to the different rail portions via their running carriages, and the wall elements can be moved into the storeroom in parallel positions lying behind one another. A drawback is the increased constructional effort and the large space requirement, because a width of the storeroom must be larger than a width of the wall elements.

It is an object of the present invention to propose a guide system mentioned in the introductory part, thereby avoiding the above-discussed drawbacks.

SUMMARY OF THE INVENTION

According to the invention, it is provided that the transfer device includes at least one control curve configured so as to be bow-shaped at least over a region, so that the at least one guide carriage, upon a transfer from the first guide rail to the carrier, can be moved at least over a region in a direction of the second guide rail.

In other words, a bow-shaped control curve is arranged or formed in a transition region between the first guide rail and the carrier, and the door wing connected to the guide carriage, upon a transfer between the first guide rail and the carrier, can run, at least over a region, in a direction extending transversely to the first guide rail due to the arrangement of the bow-shaped control curve.

In this way, the kinetic energy of the door wing, upon a transfer from the first guide rail to the carrier, is not dissipated, but rather maintained, at least partially, for a continued movement in a direction of the transversely extending second guide rail. The door wing connected to the guide carriage is guided by the bow-shaped control curve in a direction of the second guide rail, so that the further movement direction of the door wing relative to the second guide rail is predetermined for a continued intuitive movement.

The control curve can be arranged, at least partially within a region, seen in a top view, lying between the first guide rail and the carrier in the mounted condition.

The guide carriage can have at least one running wheel configured to run along the control curve.

According to an embodiment, the transfer device can include an adaptor portion on which the control curve is arranged or formed. The adaptor portion is arranged on an end region of the first guide rail and adjoins the first guide rail in a longitudinal direction, so that the guide carriage, upon a transfer from the first guide rail to the carrier, can be moved at least over a region along the control curve of the adaptor portion.

According to a further embodiment, a locking device for releasably locking the carrier to the adaptor portion can be provided. The locking device can include at least one pivotally mounted actuating lever having a locking position and an unlocking position. The carrier is locked relative to the adaptor portion in the locking position of the actuating lever, and the carrier is unlocked from the adaptor portion in the unlocking position of the actuating lever. The actuating lever in question, starting from the locking position, can be moved from the locking position into the unlocking position by a transfer of the guide carriage from the first guide rail to the carrier, and is configured to be acted upon by the guide carriage, and, as a result, can be moved into the unlocking position.

The arrangement according to the invention comprises at least one door wing and a guide system of the described type for guiding the at least one door wing. The arrangement can further comprise a second door wing which is hingedly connected to the first door wing by a vertically extending axis in the mounted condition.

The item of furniture according to the invention comprises a guide system and/or an arrangement of the described type.

BRIEF DESCRIPTION OF THE DRAWINGS

Further details and advantages of the present invention result from the following description of figures, in which.

DETAILED DESCRIPTION OF THE INVENTION

Figure 1A:
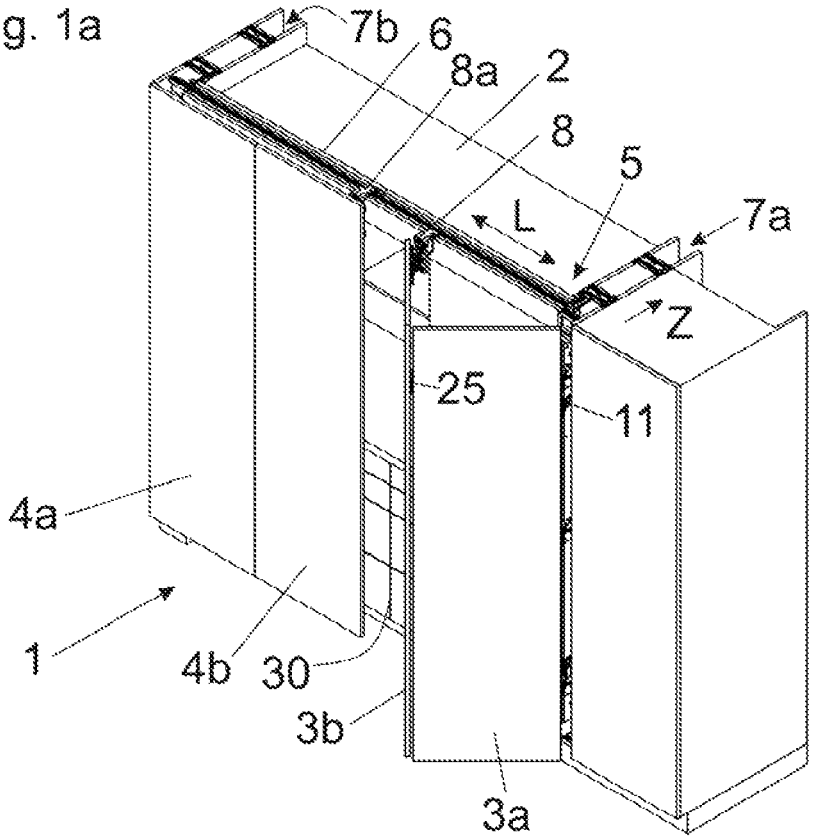
FIG. 1*a*, 1*b* are two perspective views of an item of furniture having door wings configured to be moved by a guide system relative to a furniture carcass.

FIG. 1*a* shows a perspective view of an item of furniture 1 having door wings 3*a*, 3*b* and 4*a*, 4*b* configured to be moved by a guide system 5 relative to a furniture carcass 2. The guide system 5 includes a first guide rail 6 having a longitudinal direction (L), and a second guide rail 11 extending transversely, preferably at a right angle, to the longitudinal direction (L) for guiding the door wings 3*a*, 3*b* in a direction (Z). A guide carriage 8 connected to the door wing 3*b* is provided, the guide carriage 8 being configured to be moved along the first guide rail 6 and relative to the second guide rail 11. For example, the first guide rail 6 can rest against an upper side of the furniture carcass 2. The first guide rail 6 and the second guide rail 11 can be spaced from one another in a height direction or can also be arranged at a same height. The door wings 3*a*, 3*b*, in a parallel position to one another, can be inserted into a lateral cavity 7*a*. By a second guide carriage 8*a* connected to the door wing 4*b*, the other two door wings 4*a*, 4*b* can be moved relative to the first guide rail 6 and can be inserted, in parallel position to one another, into a second lateral cavity 7*b*. Each of the door wings 3*a*, 3*b* and 4, 4*a* are pivotally connected to one another by furniture hinges 25, and each of the door wings 3*a*, 3*b* and 4*a*, 4*b* are hingedly connected to one another about a vertically extending axis.

Figure 1B:
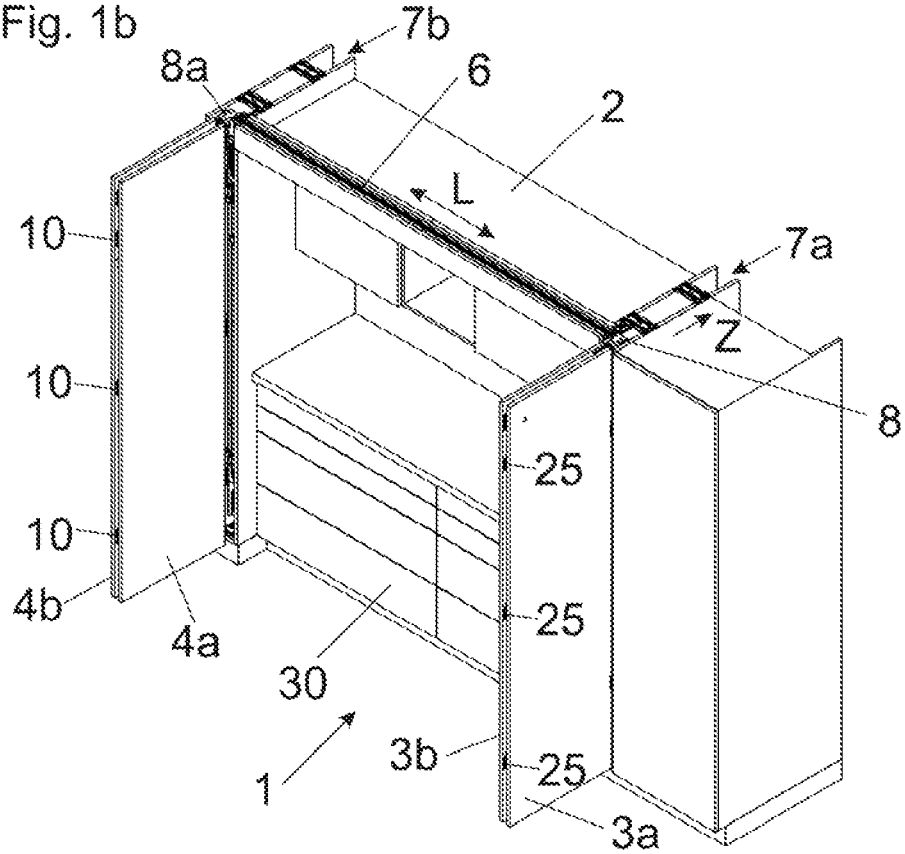

FIG. 1*b* shows the item of furniture 1, in which each of the door wings 3*a*, 3*b* and 4*a*, 4*b* are aligned parallel to one another and can be inserted into the lateral cavities 7*a*, 7*b* in a direction (Z) extending transversely to the longitudinal direction (L). The first door wing 3*a* and the second door wing 3*b* are connected to one another by a plurality of furniture hinges 25. The door wings 3*a*, 3*b* are movably supported from a first parallel position, in which the door wings 3*a*, 3*b* can be inserted into the lateral cavity 7*a*, and a second position, in which the door wings 3*a*, 3*b* adopt a coplanar position to one another, thereby covering an inner cabinet 30.

Figure 2:
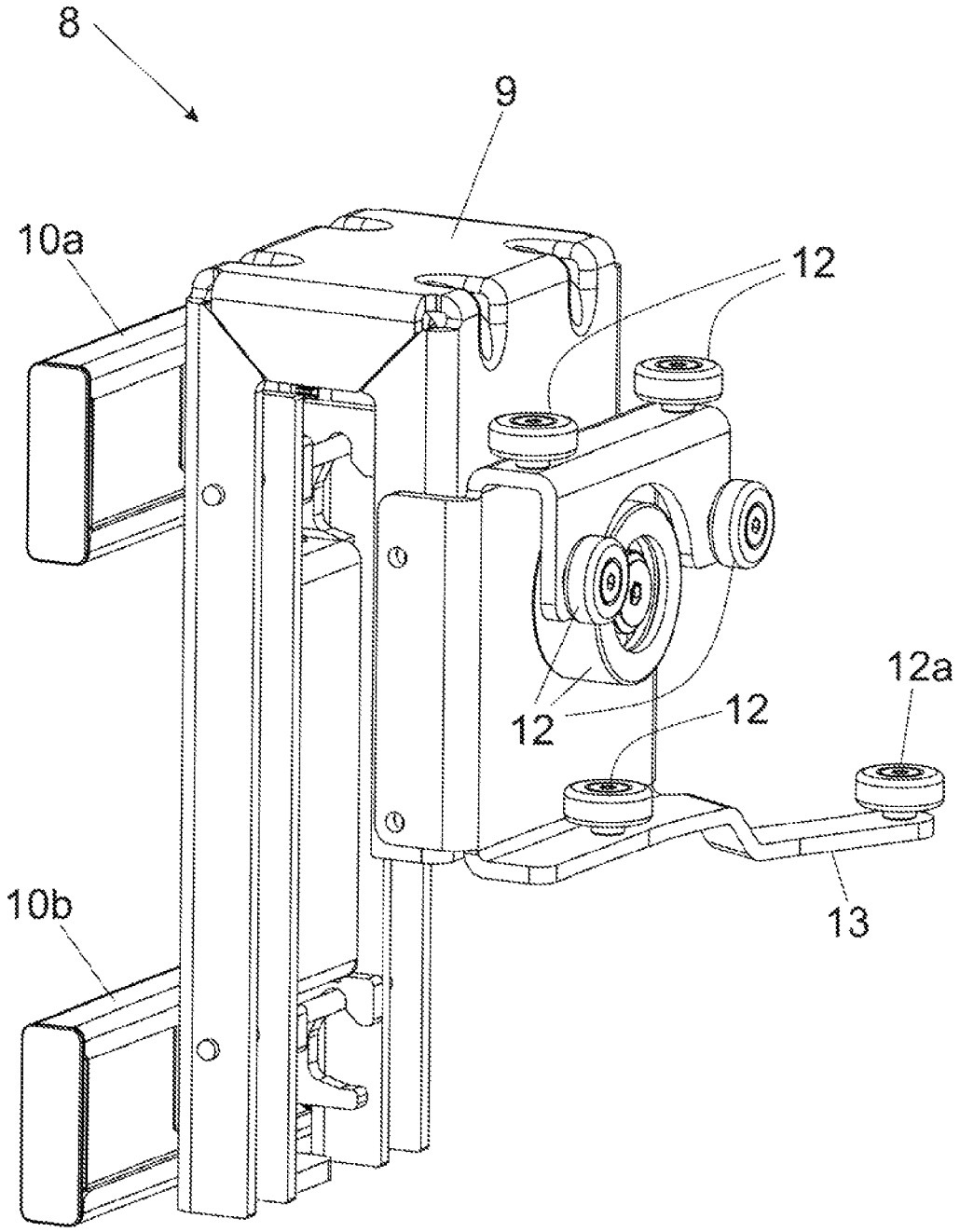
FIG. 2 is a perspective view of a guide carriage configured to be connected to a door wing.

FIG. 2 shows a perspective view of the guide carriage 8 configured to run along the first guide rail 6. The guide carriage 8 includes a, preferably U-shaped, carrier profile 9 on which at least one fitting portion 10*a*, preferably two fitting portions 10*a*, 10*b* spaced from each other in a height direction, is or are pivotally mounted to the carrier profile 9 about an axis extending vertically in the mounted position. Each of the fitting portions 10*a* and 10*b* are to be fixed to the door wing 3*b*. The guide carriage 8 includes at least one or a plurality of running wheel(s) 12, 12*a*, and it is preferably provided that the running wheel 12*a* is configured to run along a bow-shaped control curve 21 (FIG. 5*c*) of a transfer device 15. The running wheel 12*a* is rotationally supported on an extension portion 13 of the guide carriage 8, the extension portion 13 protruding transversely from the carrier profile 9. Preferably, the running wheel 12*a* is rotationally supported about a vertically extending axis. Thereby, it can be provided that the extension portion 13 protrudes transversely from the carrier profile 9 within an angle range of between 25° and 50° and/or that the running wheel 12*a* adopts the highest or the lowest position in relation to the remaining running wheels 12 of the guide carriage 8.

Figure 3:
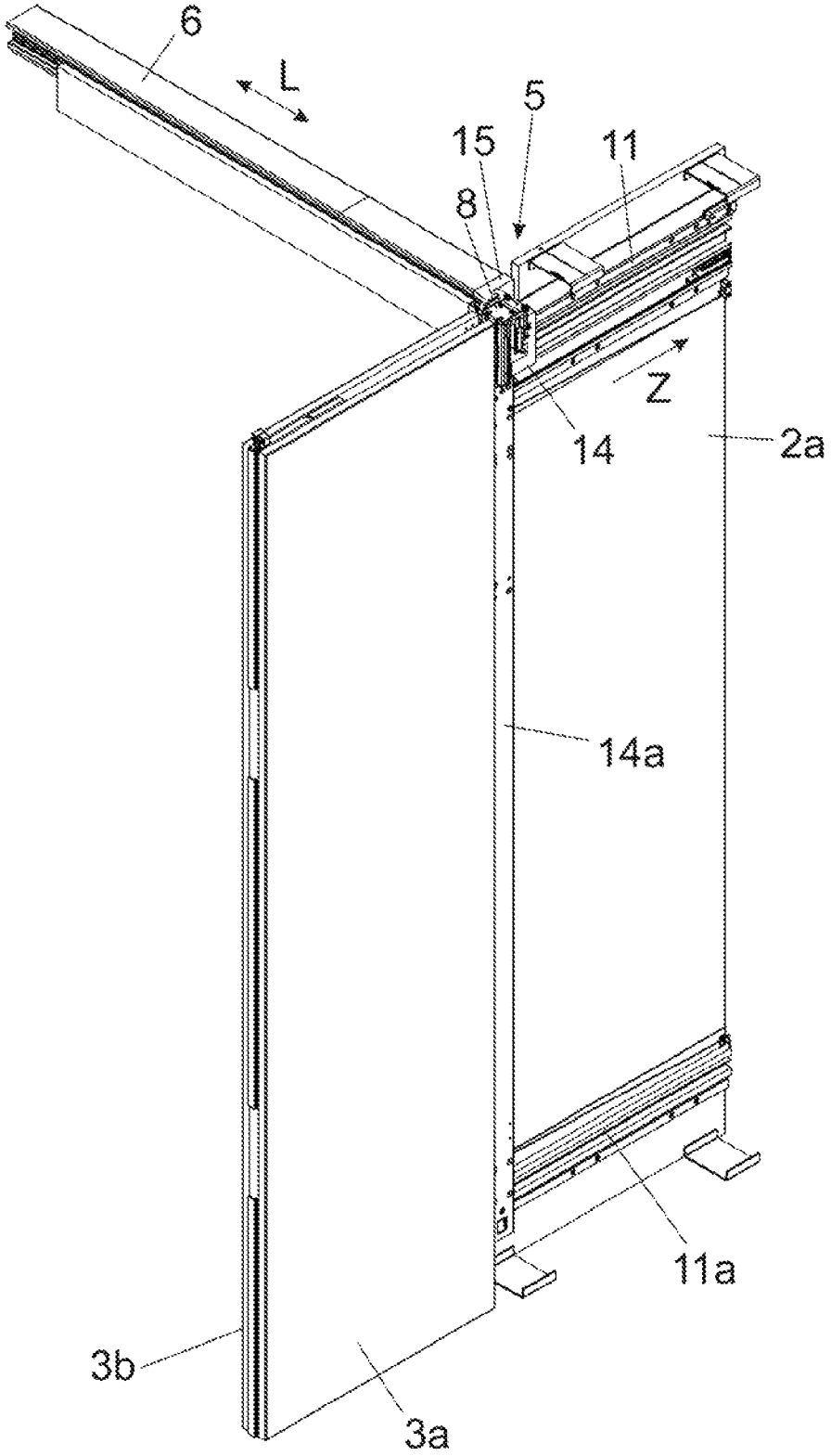
FIG. 3 is a perspective view of the guide system.

FIG. 3 shows the guide system 5 for guiding the door wings 3*a* and 3*b*, and the guide system 5 includes a first guide rail 6 having a longitudinal direction (L) and a second guide rail 11 extending transversely relative thereto. The guide carriage 8 is configured to run along the first guide rail 6 and can be arranged on a carrier 14. The carrier 14, together with the guide carriage 8, is movable relative to the second guide rail 11 in the direction (Z). The carrier 14 is connected to a vertically extending column 14*a* (for example a profiled rail), and the column 14*a* can be guided relative to a further guide rail 11*a*. By a transfer device 15, the guide carriage 8 can be transferred from the first guide rail 6 to the carrier 14. The transfer device 15 includes at least one bow-shaped control curve 21, so that the guide carriage 8, upon a transfer from the first guide rail 6 to the carrier 14, can be moved at least over a region in the direction (Z) relative to the second guide rail 11. The other door wing 3*a* is connected by a plurality of hinges (not shown) to the column 14*a*.

Figure 4A:
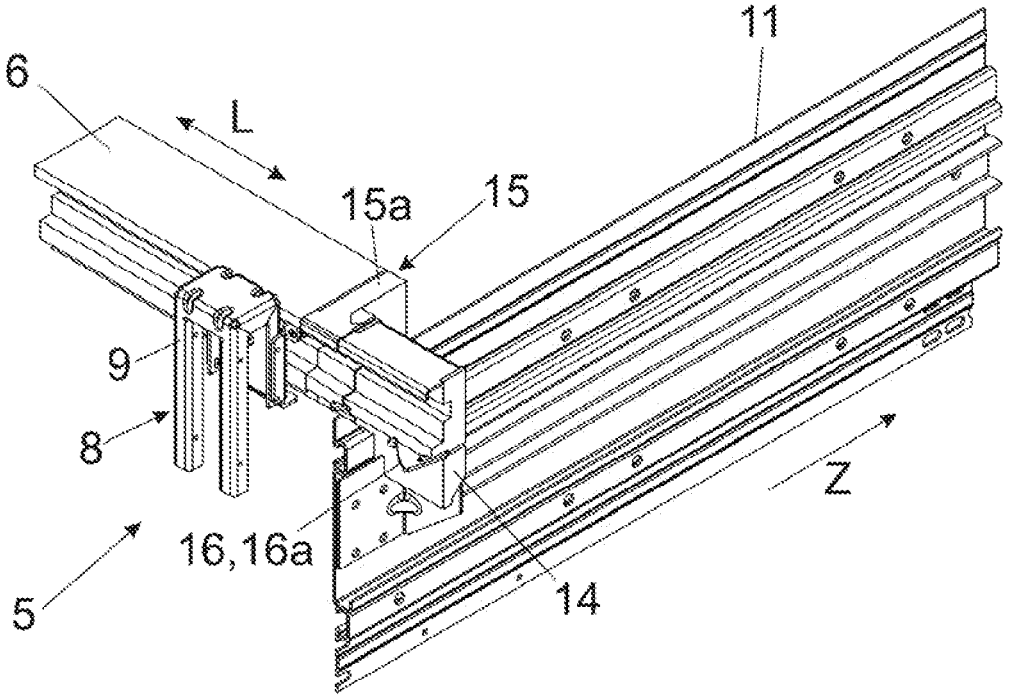
FIG. 4*a*, 4*b* are a perspective view of the guide system in a first position of the guide carriage, and a horizontal cross-sectional view thereof.

FIG. 4*a* shows the guide system 5 with the first guide rail 6 along which the guide carriage 8 with the carrier profile 9 is displaceably supported in the longitudinal direction (L). For the sake of improved overview, the running wheels 12, 12*a* of the guide carriage 8 are not depicted. The transfer device 15 includes an adaptor portion 15*a* on which the control curve 21 for controlling a movement of the guide carriage 8 is arranged or formed. The adaptor portion 15*a* is arranged on an end region of the first guide rail 6 and adjoins the first guide rail 6 in the longitudinal direction (L), so that the guide carriage 8, upon a transfer from the first guide rail 6 to the carrier 14, is movable at least over a region along the control curve 21 of the adaptor portion 15*a*. The control curve 21 does not emerge from this figure. According to an embodiment, the control curve 21 is arranged or formed on an underside of the adaptor portion 15 for guiding the running wheel 12*a* (FIG. 2) of the guide carriage 8. The carrier 14 can be releasably locked by a locking device 16 relative to the adaptor portion 15*a*, so that the carrier 14—as long as the guide carriage 8 is located on the first rail 6—cannot be moved in the direction (Z). The locking device 16 can include at least one pivotally mounted actuating lever 16*a* having a locking position and an unlocking position. In the locking position of the actuating lever 16*a*, the carrier 14 is locked relative to the adaptor portion 15*a*. In the unlocking position of the actuating lever 16*a*, the carrier 14 is unlocked relative to the adaptor portion 15*a*.

Figure 4B:
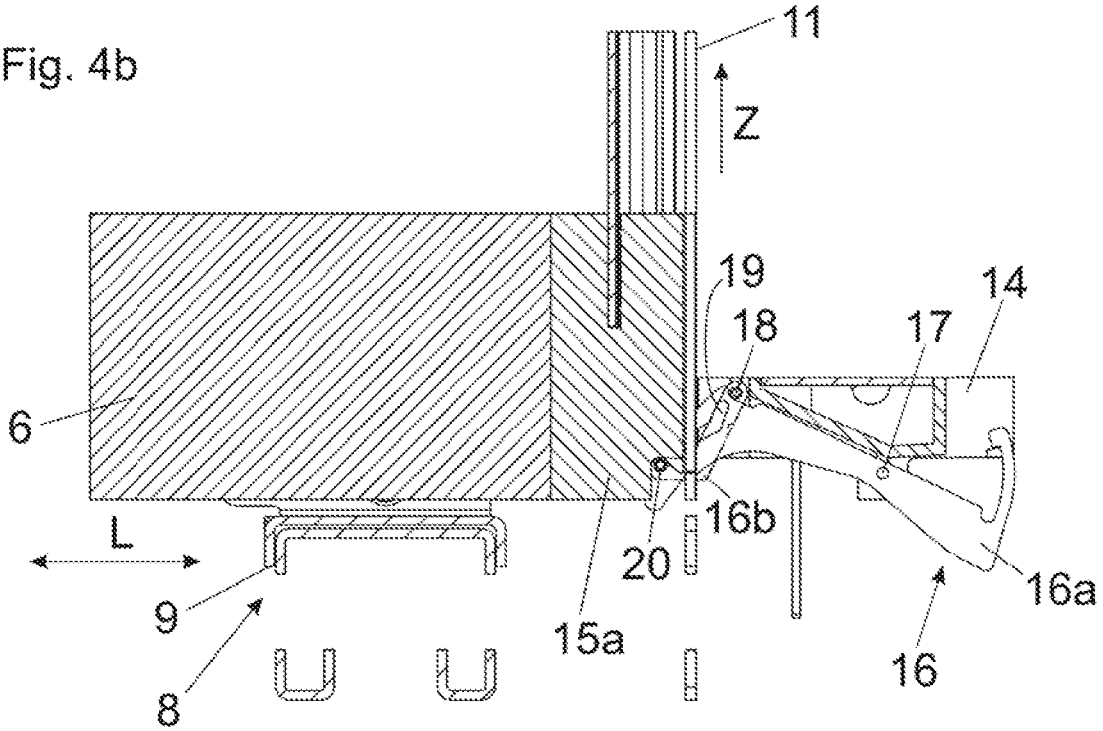

FIG. 4*b* shows the guide system 5 according to FIG. 4*a* in a horizontal cross-sectional view. The locking device 16 for releasably locking the carrier 14 relative to the adaptor portion 15*a* includes the actuating lever 16*a*, the actuating lever 16*a* being pivotally arranged on the carrier 14 about a vertically extending pivoting axis 17. The locking device 16 further includes a locking lever 16*b* for locking the carrier 14 to the adaptor portion 15*a*, and the locking lever 16*b* is configured to be moved by the actuating lever 16*a*. In the shown embodiment, the locking lever 16*b* is pivotally arranged on the carrier 14 about a hinge axis 18. The, preferably L-shaped, locking lever 16*b* has an end portion remote from the hinge axis 18, and that end portion has a pin 20 configured to be displaced in or along a guide 19 of the actuating lever 16*a*. The actuating lever 16*a*—starting from the shown locking position—can be acted upon by the guide carriage 8 upon a transfer of the guide carriage 8 from the first guide rail 6 to the carrier 14 and, as a result, can be moved in an unlocking position in which the carrier 14 is released.

Figure 5A:
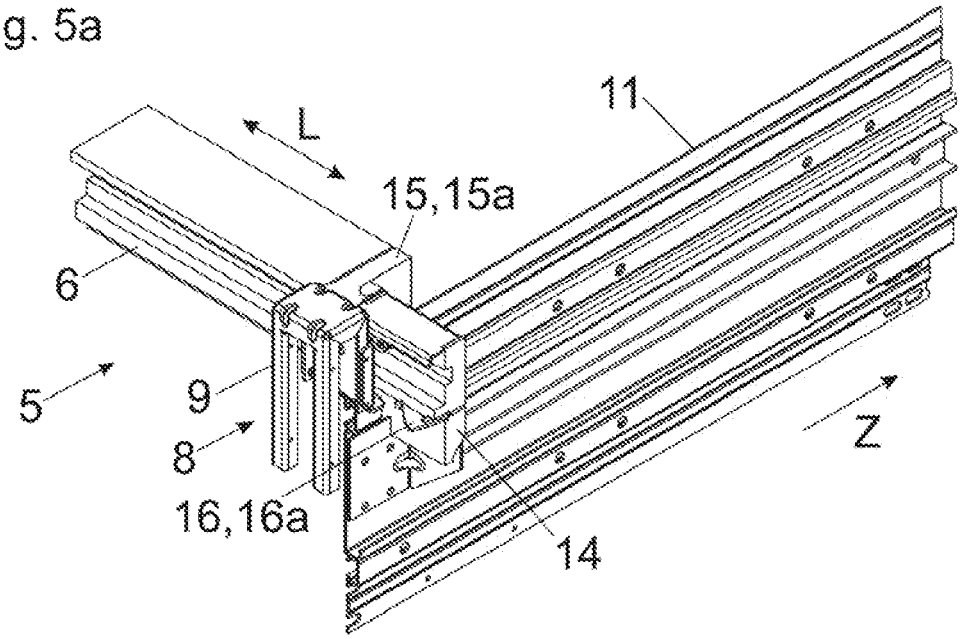
FIG. 5*a*-5*c* are a perspective view of the guide system in a second position of the guide carriage, and two horizontal cross-sectional views thereof.
Figure 5B:
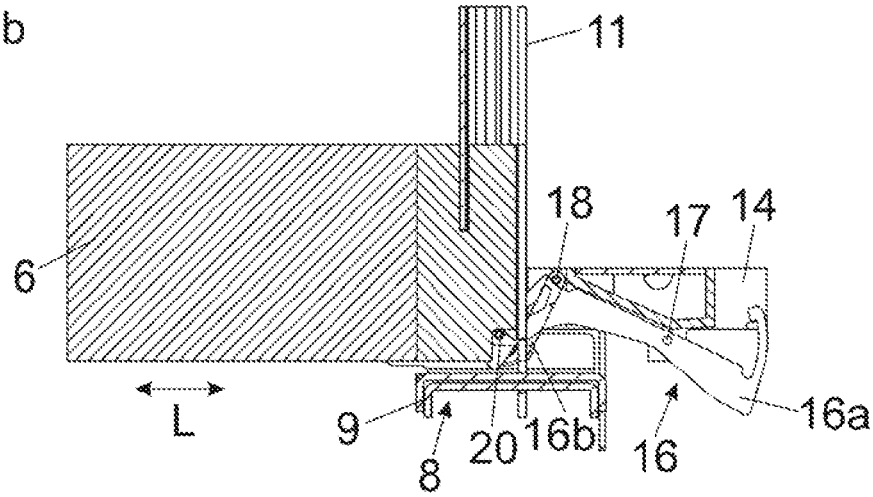
Figure 5C:
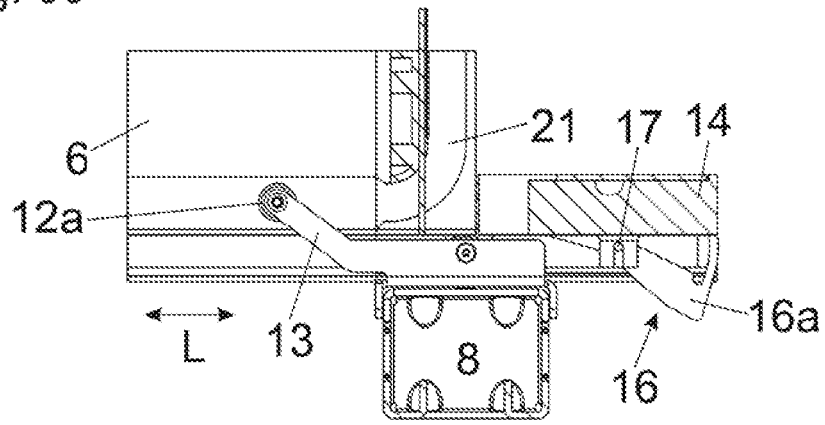

FIG. 5*a* shows the guide system 5 in a further relative position of the guide carriage 8 along the first guide rail 6, and the carrier 14 is still locked to the adaptor portion 15*a* of the transfer device 15. FIG. 5*b* shows a first horizontal cross-sectional view of the guide system 5 according to FIG. 5*a*, in which the guide carriage 8 approaches towards the actuating lever 16*a*, pivotally mounted about the pivoting axis 17, of the locking device 16. FIG. 5*c* shows a second, lower lying horizontal cross-sectional view of the guide system 5 according to FIG. 5*a* and FIG. 5*b*, showing the guide carriage 8 with the running wheel 12*a* rotatably arranged on the extension portion 13 (FIG. 2) and the control curve 21 of the transfer device 15 in greater detail. The control curve 21 is configured so as to be bow-shaped at least over a region and is arranged on the underside and/or an upper side of the adaptor portion 15*a*, and the running wheel 12*a* of the guide carriage 8 is configured to run in or along the control curve 21.

Figure 6A:
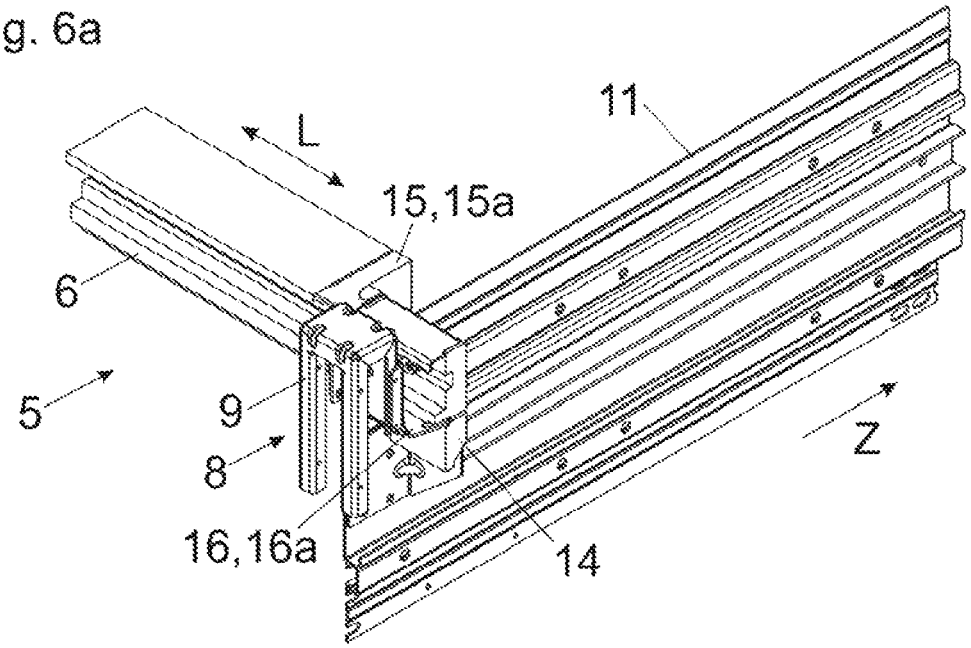
FIG. 6*a*-6*c* are a perspective view of the guide system in a third position of the guide carriage, and two horizontal cross-sectional views thereof.
Figure 6B:
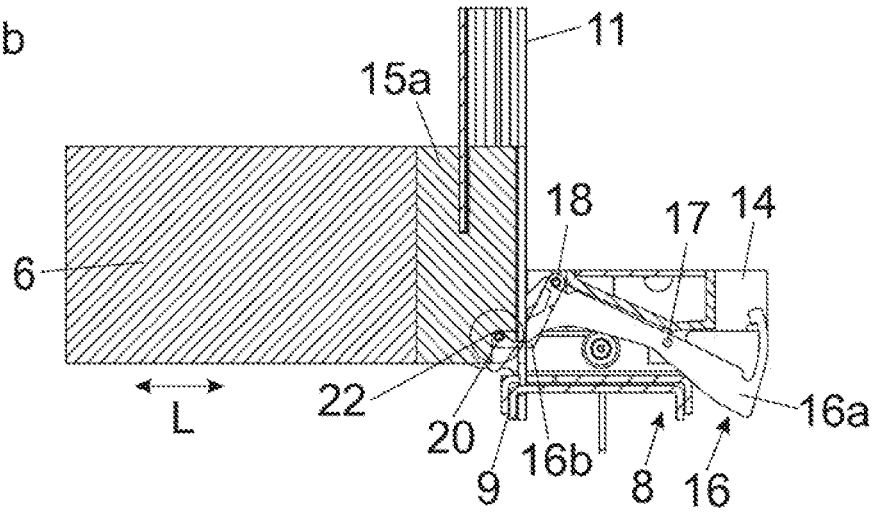
Figure 6C:
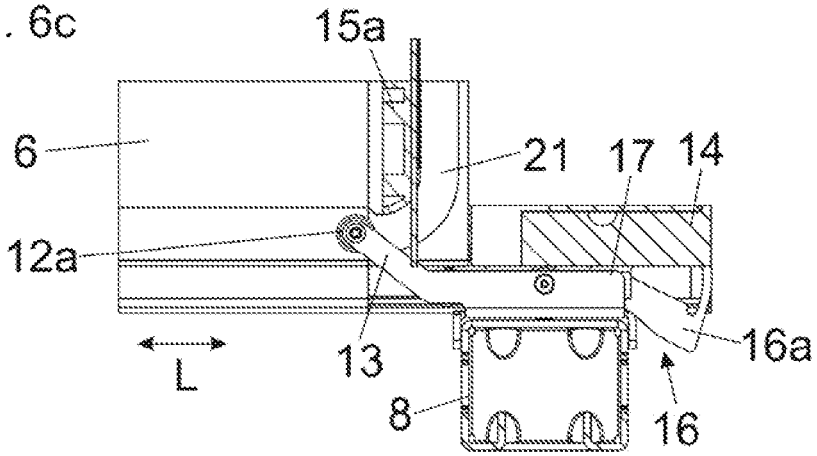

FIG. 6*a* shows the guide system 5 in a further position of the guide carriage 8, and the guide carriage 8 now abuts against the actuating lever 16*a* of the locking device 16. The first horizontal cross-sectional view according to FIG. 6*b* shows that the actuating lever 16*a* is pivotally mounted about the pivoting axis 17 and is configured as a two-armed lever having a first lever end and a second lever end. The guide carriage 8 abuts against a first lever end of the actuating lever 16*a*, the second lever end of the actuating lever 16*a* has a guide 19 (FIG. 4*b*) in which the pin 20 of the locking lever 16*b* is displaceably guided. The pin 20 of the locking lever 16*b* cooperates, in the shown locking position, with a locking recess 22 of the adaptor portion 15*a*, so that the carrier 14 remains locked. FIG. 6*c* shows a second, lower lying horizontal cross-sectional view of the guide system 5 according to FIG. 6*a* and FIG. 6*b*, in which the running wheel 12*a* of the guide carriage 8 enters the control curve 21.

Figure 7A:
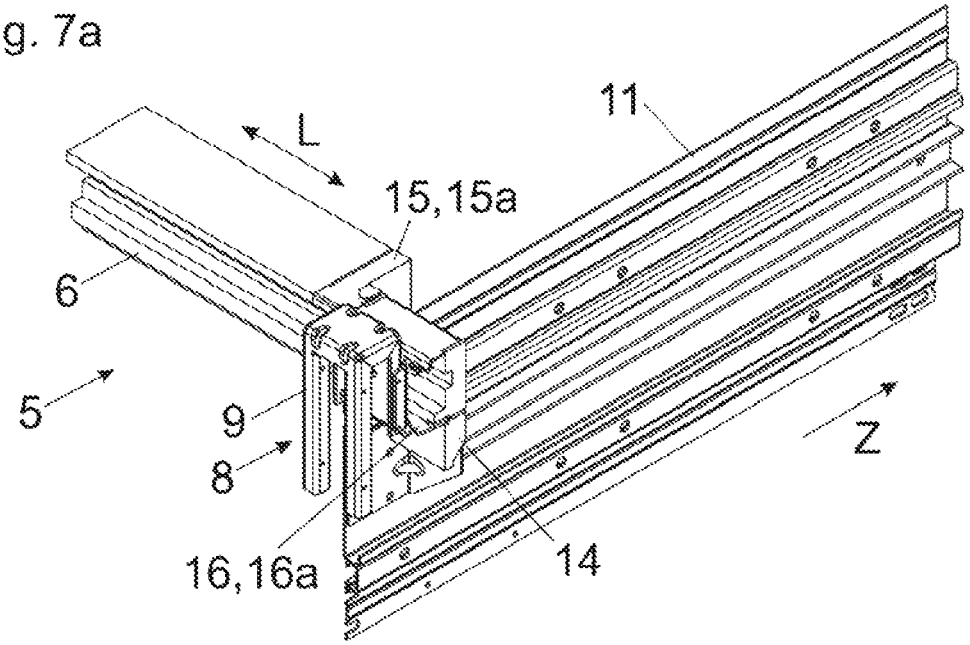
FIG. 7*a*-7*c* are a perspective view of the guide system in a fourth position of the guide carriage, and two horizontal cross-sectional views thereof.
Figure 7B:
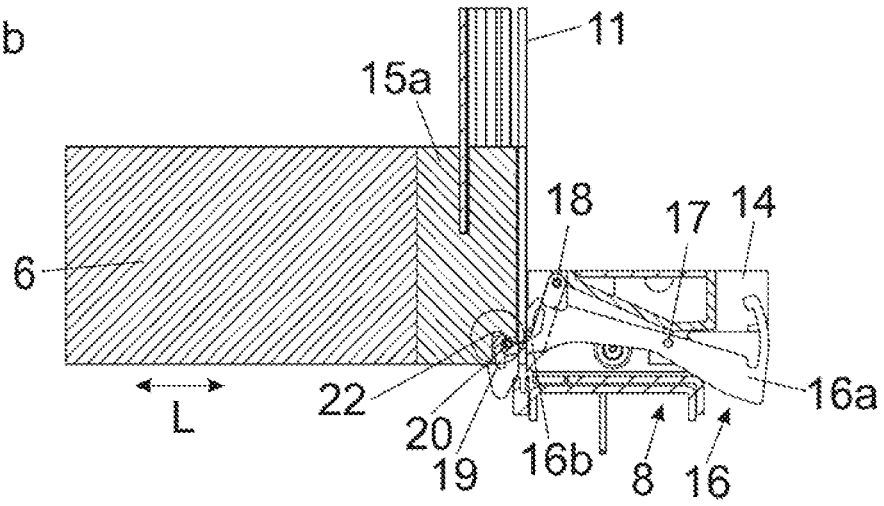
Figure 7C:
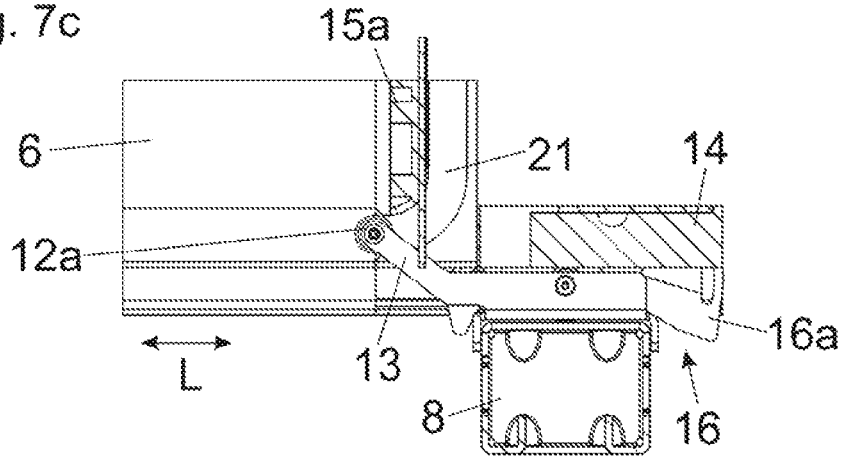

FIG. 7*a* shows a continued movement of the guide carriage 8 in relation to FIG. 6*a*, in which the guide carriage 8 abuts against the actuating lever 16*a*. The first horizontal cross-sectional view according to FIG. 7*b* shows that the guide carriage 8 moves the actuating lever 16*a* in an anticlockwise direction about the pivoting axis 17, so that the pin 20 of the locking lever 16*b* moves along the guide 19 of the adaptor portion 16*a* and, as a result, is unlocked from the locking recess 22 of the adaptor portion 15*a*. The second horizontal cross-sectional view according to FIG. 7*c* shows that the running wheel 12*a* of the guide carriage 8 can be displaced along the control curve 21.

Figure 8A:
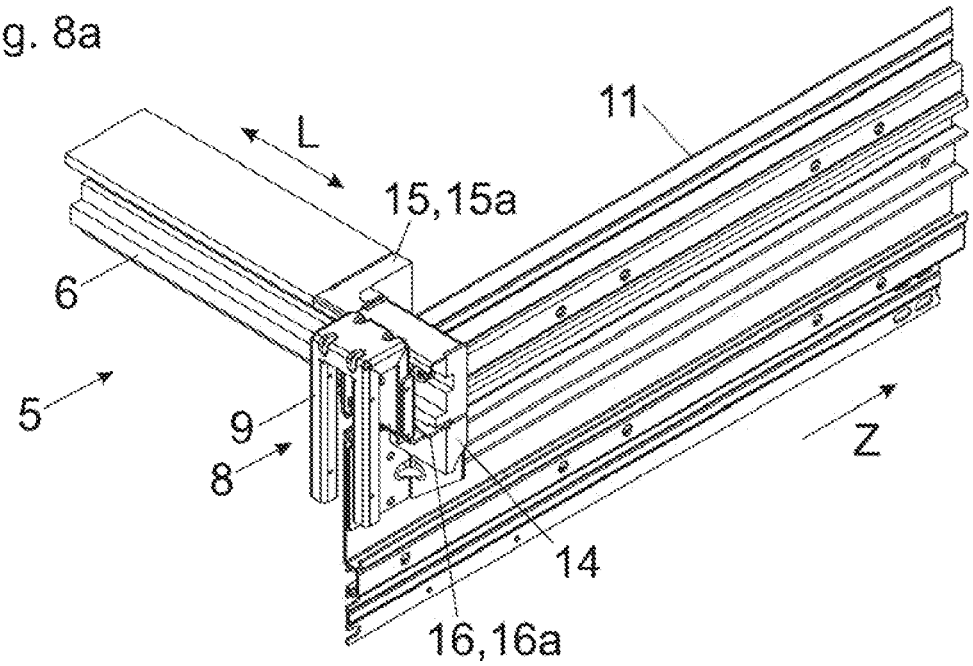
FIG. 8*a*-8*c* are a perspective view of the guide system in a fifth position of the guide carriage, and two horizontal cross-sectional views thereof.
Figure 8B:
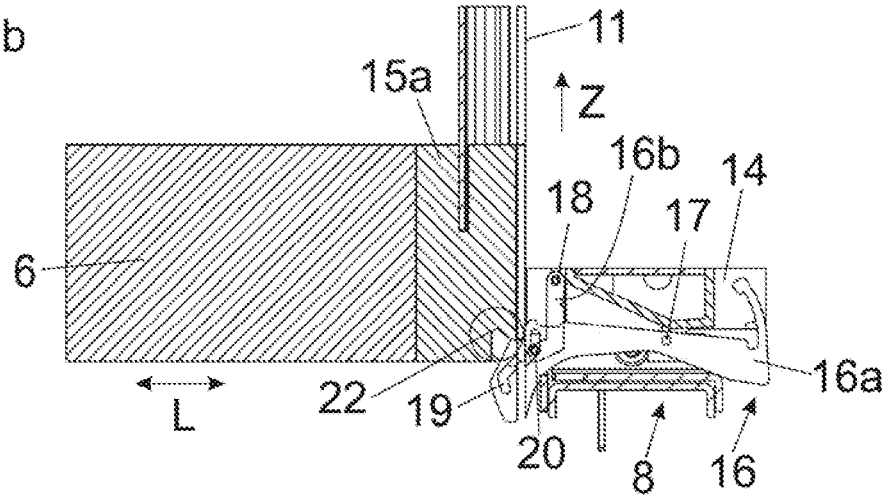
Figure 8C:
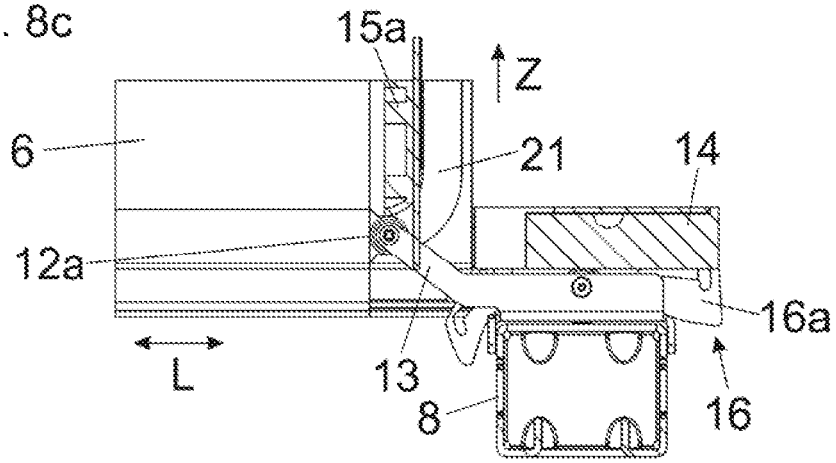

FIG. 8*a* shows a continued movement of the carrier 8, whereby the actuating lever 16*a* has further been pivoted about the pivoting axis 17 in the anticlockwise direction (FIG. 8*b*) and the pin 20 of the locking lever 16*b* is unlocked from the locking recess 22 of the adaptor portion 15*a*. The running wheel 12*a* of the guide carriage 8 is meanwhile further displaceable along the control curve 21 (FIG. 8*c*). Accordingly, the carrier 14 is now unlocked from the adaptor portion 15*a* and can further be moved relative to the second guide rail 11 in the direction (Z).

Figure 9A:
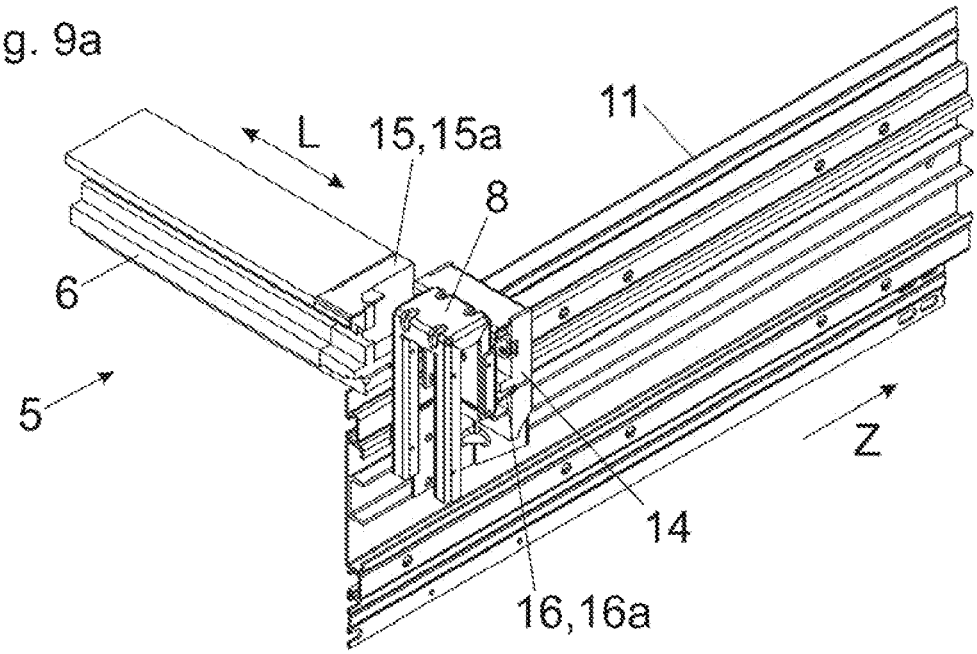
FIG. 9*a*-9*c* are a perspective view of the guide system in a sixth position of the guide carriage, and two horizontal cross-sectional views thereof.
Figure 9B:
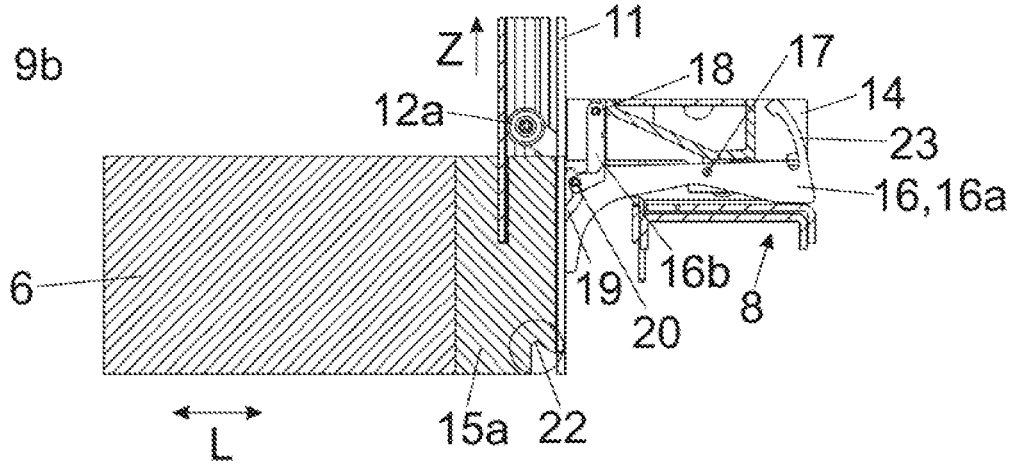
Figure 9C:
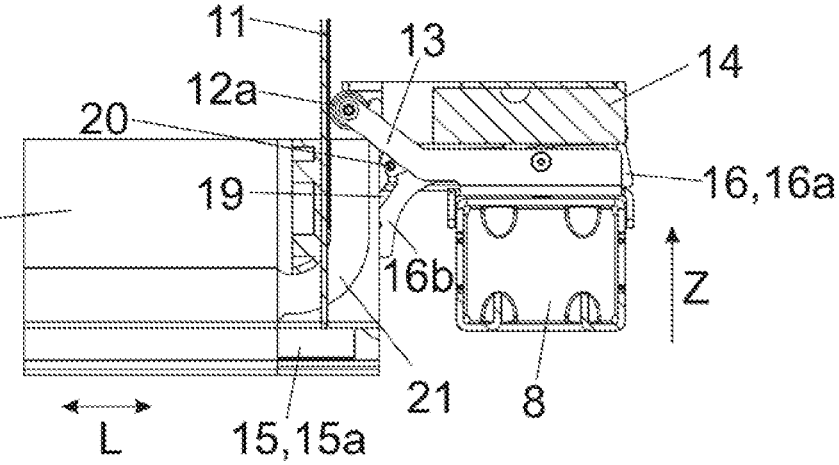

FIG. 9*a*-9*c* shows a perspective view of the guide system 5 in a further position of the guide carriage 8, and two different horizontal cross-sectional views thereof. After unlocking, the carrier 14—jointly with the guide carriage 8 arranged thereon and jointly with the column 14*a* (FIG. 3) connected to the carrier 14—can be further displaced in the direction (Z). The movement in the direction (Z) can be effected either manually and/or by a spring-assisted self-retracting device. The locking device 16 further includes at least one force storage member 23 for pre-stressing the actuating lever 16*a* in a direction of the locking position. The force storage member 23 can be formed either by an own elasticity of a resilient material portion or by at least one helical spring, for example in the form of a compression spring.

Figure 10:
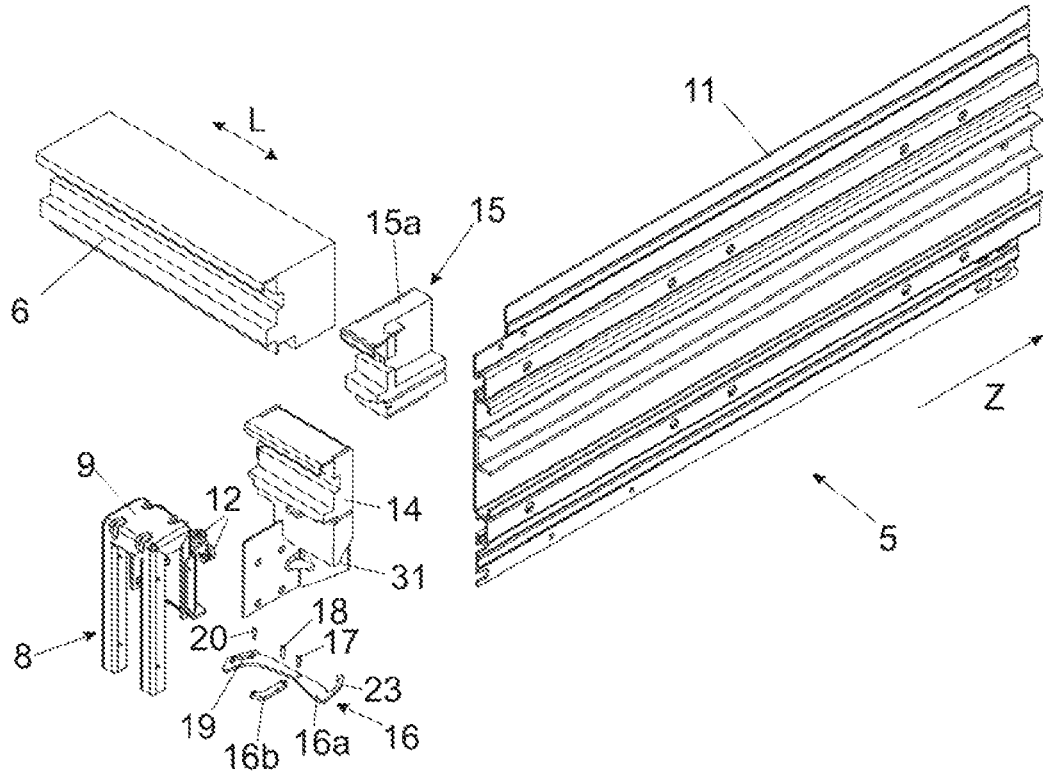
FIG. 10 shows the guide system in an exploded view.

FIG. 10 shows the guide system 5 in an exploded view. The first guide rail 6 and the second guide rail 11 are configured so as to be separate from one another and extend transversely, preferably at a right angle, to one another in the mounted condition. The guide carriage 8 with the carrier profile 9 and the running wheels 12 arranged thereon are configured to run along the first guide rail 6 in the longitudinal direction (L). The transfer device 15 for transferring the guide carriage 8 from the first guide rail 6 to the carrier 14 includes the adaptor portion 15*a* having the control curve 21 (not shown here) for guiding the running wheel 12*a* (FIG. 2) of the guide carriage 8. The carrier 14 can be releasably locked relative to the adaptor portion 15*a* by the locking device 16. The actuating lever 16*a* is pivotally mounted about the pivoting axis 17 and includes a guide 19 for controlling the pin. Preferably, the guide 19 is configured so as to be S-shaped or Z-shaped at least over a region. The pin 20 is arranged on the locking lever 16*b* pivotally mounted about the hinge axis 18. The carrier 14 is connected or is configured to be connected via a bearing portion 31 to the vertically extending column 14*a* (FIG. 3).

The invention claimed is:

1. A guide system for guiding a movably supported door wing, the guide system comprising:

a first guide rail, a guide carriage configured to be connected to the door wing and further configured to run along the first guide rail, a second guide rail separate from the first guide rail, the second guide rail extending transversely to the first guide rail in a mounted condition, a carrier configured to be displaceable relative to the second guide rail, the guide carriage can be arranged on the carrier, and a transfer device for transferring the guide carriage from the first guide rail to the carrier, wherein the transfer device includes a control curve configured so as to be bow-shaped at least over a region, so that the guide carriage, upon a transfer from the first guide rail to the carrier, can be moved at least over the region in a direction of the second guide rail extending transversely to the first guide rail, and wherein the transfer device includes an adaptor portion on which the control curve is arranged or formed, wherein the adaptor portion is arranged on an end region of the first guide rail and adjoins in a longitudinal direction of the first guide rail, so that the guide carriage, upon a transfer from the first guide rail to the carrier, is moveable, at least over the region, along the control curve of the adaptor portion.

2. The guide system according to claim 1, wherein the guide carriage includes a running wheel configured to run along the control curve.

3. The guide system according to claim 1, further comprising a locking device for releasably locking the carrier to the adaptor portion.

4. The guide system according to claim 3, wherein the locking device includes a pivotally mounted actuating lever having a locking position and an unlocking position, wherein the carrier, in the locking position of the actuating lever, is locked relative to the adaptor portion, and wherein the carrier, in the unlocking position of the actuating lever, is unlocked relative to the adaptor portion.

5. The guide system according to claim 4, wherein the locking device includes a force storage member by which the actuating lever is pre-stressed in a direction of the locking position.

6. The guide system according to claim 4, wherein the actuating lever, starting from the locking position, can be acted upon by the guide carriage upon a transfer of the guide carriage from the first guide rail to the carrier and can therewith be moved into the unlocking position.

7. The guide system according to claim 4, wherein the locking device includes a locking lever for locking the carrier to the adaptor portion, wherein the locking lever can be moved by the actuating lever.

8. The guide system according to claim 7, wherein the actuating lever has a guide, wherein the locking lever for controlling a movement of the locking lever can be guided in or along the guide of the actuating lever.

9. The guide system according to claim 8, wherein the guide has a S-shaped or a Z-shaped configuration at least over a region.

10. An arrangement comprising: the door wing and the guide system according to claim 1 for guiding the door wing.

11. The arrangement according to claim 10, wherein the door wing is a first door wing, the arrangement further comprising a second door wing hingedly connected to the first door wing by a vertically extending axis in the mounted condition.

12. An item of furniture comprising the guide system according to claim 1.

13. The item of furniture according to claim 12, wherein the door wing is one of at least two door wings, the item of furniture further comprising a furniture carcass and the at least two door wings movably supported relative to the furniture carcass, wherein the at least two door wings are hingedly connected to one another by a vertically extending axis in the mounted position, and the at least two door wings are moveable by the guide system between a first position, in which the at least two door wings are aligned substantially parallel to one another, and a second position, in which the at least two door wings are aligned substantially coplanar to one another.

14. The item of furniture according to claim 13, further comprising a lateral cavity for accommodating the at least two door wings, wherein the at least two door wings in the first position, in which the at least two door wings are aligned substantially parallel to one another, are insertable into the at lateral cavity.

* * * * *